US005524601A

United States Patent [19]

Slates et al.

[11] Patent Number: 5,524,601

[45] Date of Patent: Jun. 11, 1996

[54] ARCHERY BOW PIN SIGHT AND MOUNT

[75] Inventors: Scott O. Slates; Donald R. Sappington, both of St. Charles County, Mo.

[73] Assignee: Toxonics Manufacturing Inc., Wentzville, Mo.

[21] Appl. No.: 384,002

[22] Filed: Feb. 6, 1995

Related U.S. Application Data

[63] Continuation-in-part of Ser. No. 91,911, Jul. 16, 1993, Pat. No. 5,379,746, which is a continuation-in-part of Ser. No. 233,754, Apr. 26, 1994, Pat. No. 5,460,156, which is a continuation-in-part of Ser. No. 127,041, Sep. 27, 1993, Pat. No. 5,414,936.

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 3,854,217 | 12/1974 | Killian | 33/265 |
| 4,020,560 | 5/1977 | Heck | 33/265 |
| 4,535,747 | 8/1985 | Kudlacek | 124/87 |
| 4,625,421 | 12/1986 | Strauss | 33/265 |
| 4,715,126 | 12/1987 | Holt | 33/265 |
| 4,757,614 | 7/1988 | Kudlacek | 33/265 |
| 4,761,888 | 8/1988 | Kudlacek | 33/265 |
| 4,819,611 | 4/1989 | Sappington | 124/87 |
| 5,072,716 | 12/1991 | Sappington | 124/87 |
| 5,174,269 | 12/1992 | Sappington | 124/87 |
| 5,289,814 | 3/1994 | Maisano | 124/87 |
| 5,379,746 | 1/1995 | Sappington | 124/87 |
| 5,384,966 | 1/1995 | Gibbs | 33/265 |
| 5,419,051 | 5/1995 | Barngrover | 33/265 |

FOREIGN PATENT DOCUMENTS 2420736 10/1979 France .

*Primary Examiner* Eric K. Nicholson
*Assistant Examiner* John A. Ricci
*Attorney, Agent, or Firm* Paul M. Denk

[57] ABSTRACT

An archery bow sight of the present invention includes slide and a two-part mount secured to the slide for axial movement relative to the slide. A sight, preferably a pin sight, is secured to the sight mount. The slide includes a slide bar and a threaded rod rotatably journaled in the slide forwardly of the slide bar. The slide bar defines a pair of elongate, generally V-shaped grooves formed in its sides. The two part mount includes a first part and a second part. Each part includes a body having an inner surface and a leg extending rearwardly of the body. The legs each define an inner surface shaped complimentary to the slide bar groove to be received in the slide bar groove. A threaded bar, through which the threaded rod extends, is secured in the first part of the mount and extends through the second part of the mount. A knob is screwed on the end of the threaded bar. When the knob is tightened against the second part, the inner surface of the bodies are brought into contact with each other and the legs of the first and second part are moved inwardly toward each other so that they clamp down on the slide bar to secure the sight in a desired position along the slide bar. When the knob is loosened, the mount may be moved by rotation of the threaded rod for fine control over the sight's position, or the mount may be slid along the threaded rod for gross control over the sight's position.

11 Claims, 2 Drawing Sheets

ARCHERY BOW PIN SIGHT AND MOUNT

CROSS-REFERENCE TO RELATED APPLICATIONS

This application is a continuation-in-part of the application having Ser. No. 08/091,911, filed on Jul. 16, 1993, now U.S. Pat. No. 5,379,746 and in addition is a continuation-in-part of the application having Ser. No. 08/233,754, filed on Apr. 26, 1994, now U.S. Pat. No. 5,460,156 and is also a continuation-in-part of the application having Ser. No. 08/127,041, filed on Sep. 27, 1993, now U.S. Pat. No. 5,414,936 all owned by a common assignee.

BACKGROUND OF THE APPLICATION

This invention relates to archery bows, and in particular to a mount for a pin sight for an archery bow.

Bow hunters typically use pin sights when hunting game. The pin sight includes at least one pin which is positioned on the bow and is used to aim at the target, such as a deer. Before an archer hunts, the pin is positioned on the bow for a certain distance, i.e. 100 yards. If the archer is to shoot game at a different distance, the pin will have to be repositioned with respect to the bow, i.e. it will have to be moved vertically. It is important that the pin remain generally horizontal or perpendicular to the plane of the bow. On many bow sight mounts, when the pin is repositioned, the design of the mount does not ensure that the pin will remain in the desired perpendicular position.

In U.S. Pat. Nos. 5,379,746, 5,414,936, and 5,460,156, all of which are incorporated herein by reference, there is described a bow sight mount which will maintain the pin in the generally perpendicular position. The mounts described in those applications generally include a slide having outwardly beveled surfaces. The sight itself is mounted to a block having beveled surfaces which mate with the side beveled surfaces. That design works well to retain the pin perpendicular to the bow plane, however it does not include a mechanism to positively clamp the sight block to the slide.

SUMMARY OF THE INVENTION

One object of the present invention is to provide a sight mount for an archery bow.

Another object is to provide such a sight mount which positively clamps the sight in a desired location relative to the bow.

Another object is to provide such a sight mount in which the clamping is performed externally.

Another object is to provide such a sight mount wherein the sight can be easily and quickly moved relative to the bow.

These and other objects will become apparent to those skilled in the art in light of the following disclosure and accompanying drawings.

In accordance with the invention, generally stated, an archery bow sight includes a slide and a two-part mount secured to the slide for axial movement relative to the slide. A sight, preferably a pin sight, is secured to one part of the two-part sight mount. The slide includes a slide bar having a top and a bottom. Top and bottom arms extend forwardly from the slide bar and a threaded rod extends between and is rotatably journaled in the slide bar arms. The slide bar has a pair of generally V-shaped grooves formed in its sides. The grooves extend generally the full length of the slide bar. The threaded rod and grooves define a path of travel over which the two part mount is vertically movable.

The two-part mount includes a first part and a second part, the sight being secured to one of the first and second parts. The first part includes a body having an inner surface and a leg extending rearwardly from the body, a generally vertical throughbore extending through the body, and a bore formed in the inner surface and communicating with the throughbore. The leg has an inner surface shaped complimentary to the slide bar grooves and is received in a first of the slide bar grooves. The threaded end extends through the throughbore. Preferably, the back surface of the first part body is spaced forwardly of a front surface of the slide bar.

The second part of the mount includes a body having an inner surface, a leg extending rearwardly from the body, and an opening extending through the body. The leg is identical to the leg of the first part and has an inner surface shaped complimentary to the slide bar grooves to be received in a second of the bar grooves. The second part opening is axially aligned with the first part bore and the inner surfaces of the first and second parts contact at least a portion of each other.

A threaded bar is in the first part bore and extends through the second part opening. The threaded bar has a first end received in the first pan bore and a second end which extends through the second part. The first end has an opening generally aligned with the first pan throughbore through which the slide bar threaded rod extends. The threaded rod serves, in part, to hold the bar in the first part. The bar extends from the first part, across the slide, and through the second part opening. A knob is received on the second end of the threaded bar and is operable to urge the legs of the two parts into the slide bar grooves such that the two-part mount clamps against the slide bar to secure the sight in a desired position on the path of travel.

The bore in the threaded bar is generally oblong, being defined by first and second circular surfaces which intersect each other to define a continuous surface, some what in the shape of a figure eight. The first circular surface is preferably smooth and has a diameter equal to the diameter of the through bore of the first part. The second circular surface is at least partially threaded and of a diameter approximately equal to the diameter of the threaded rod. The threaded bar is biased by a spring positioned in the first part bore so that the threaded second circular surface normally engages the threaded rod of the slide. The mount can thus be moved along the path of travel by rotating the threaded rod. The threaded bar is movable perpendicularly relative to the threaded rod to disengage the threaded surface of the second circle from the threaded rod, to generally coaxially align the threaded rod with the first circular surface. In this position, the mount may be slid along the path of travel.

Preferably, the inner surfaces of the first and second parts are not fully in contact with each other. Rather, a majority of the inner surface of the first part is spaced from the inner surface of the second part and the first part includes a step which extends inwardly from the first part toward the second part to define a surface against which the inner surface of the second part contacts. The step may be integrally formed with the first part, or may be formed as a bar which is received in a groove formed in the first part. Preferably the step is positioned rearwardly of the first part bore and second part opening.

As is explained below, the two-part mount is operable to positively clamp down on the slide bar to secure the sight in a desired location along the path of travel. By loosening the knob slightly, the mount may be moved vertically either by rotating the threaded rod or by disengaging the threaded bar from the threaded rod.

DESCRIPTION OF THE PREFERRED EMBODIMENT

Figure 1:
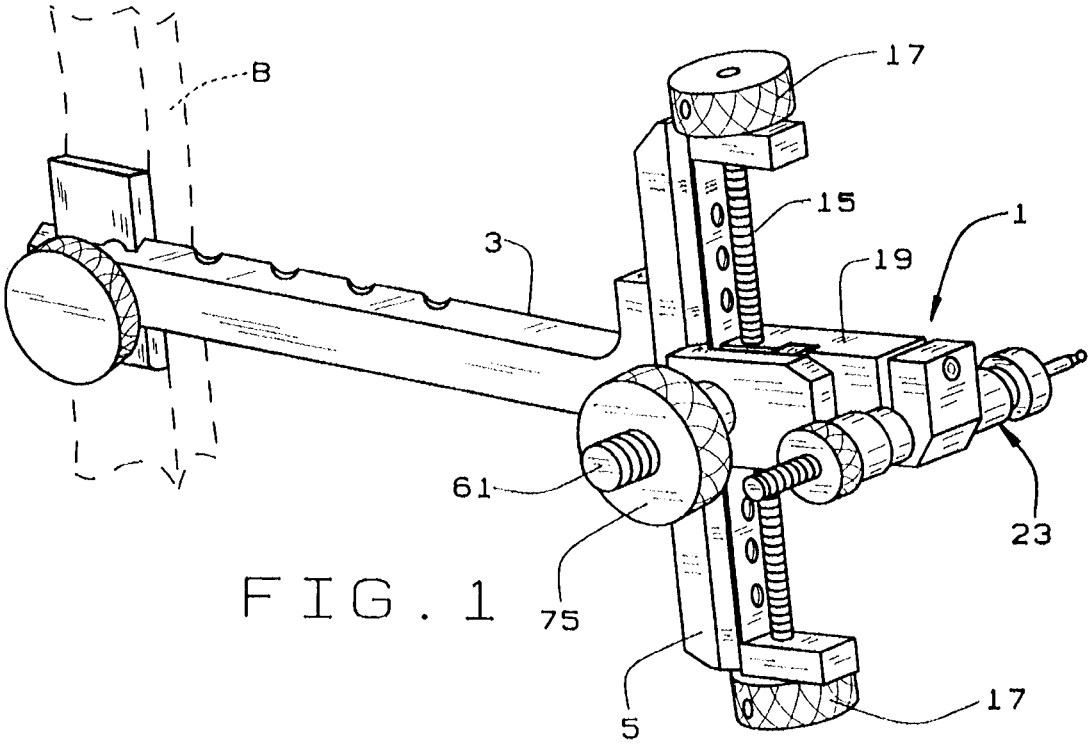
FIG. 1 is a perspective view of a bow sight assembly of the present invention mounted to a bow which is shown in phantom.
Figure 2:
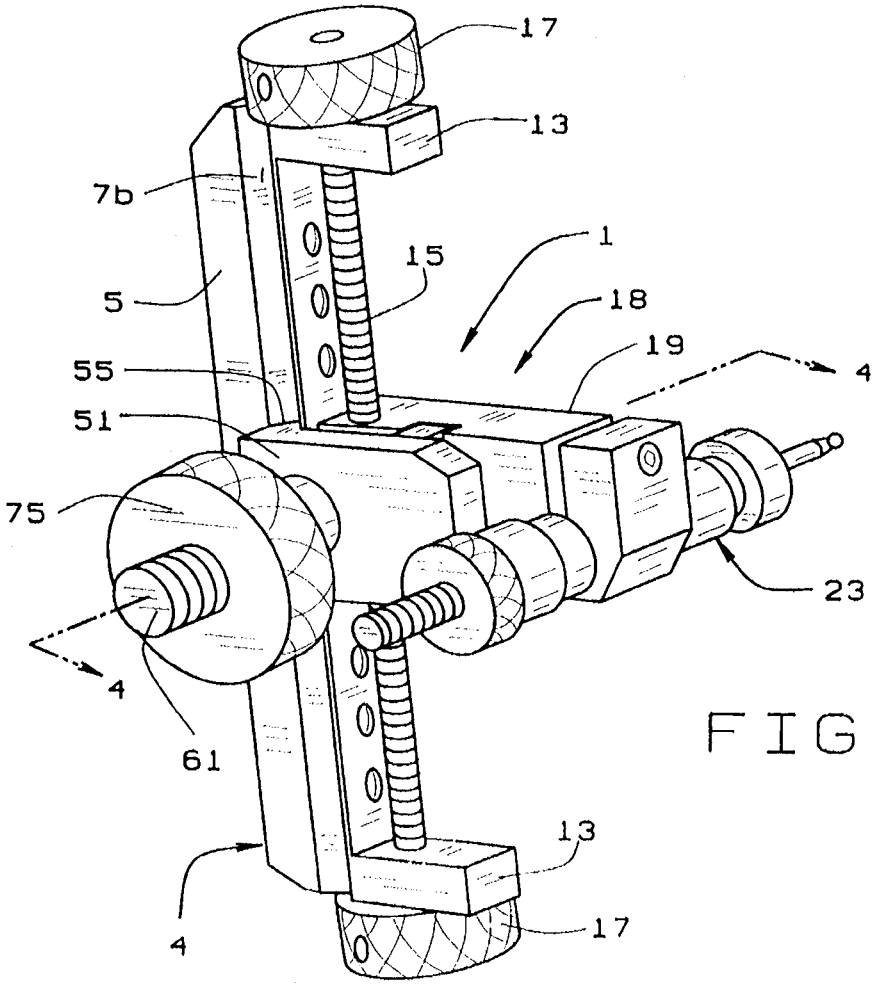
FIG. 2 is a perspective view of the bow sight assembly.
Figure 3:
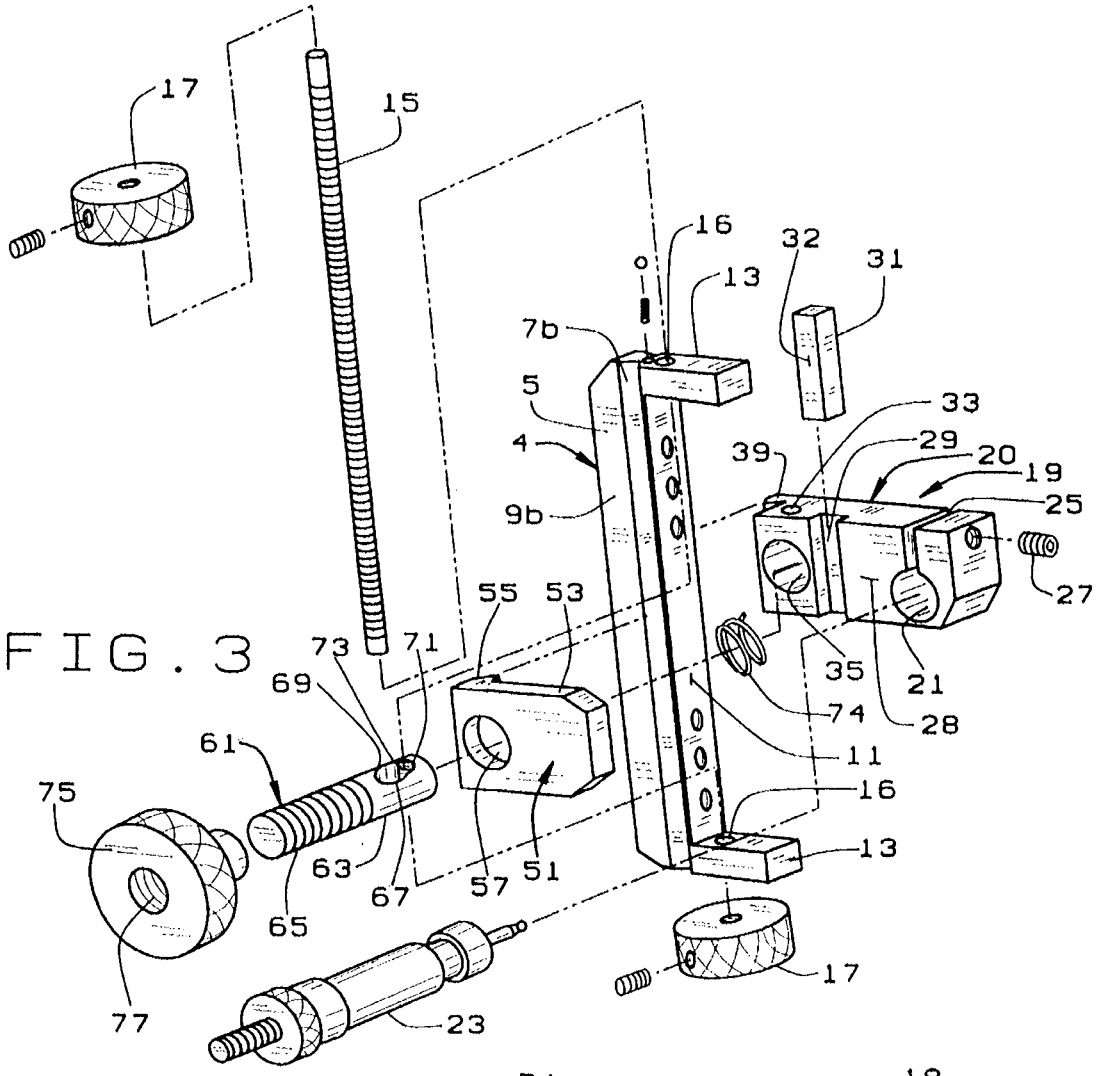
FIG. 3 is an exploded view of the bow sight assembly.

A bow sight assembly 1 of the present invention is shown generally in FIGS. 1 and 2. As is common, the assembly 1 is mounted to an arm 3 which, in turn, is mounted to a bow B. Various types of arms may be used to connect the assembly 1 to bow B, such as the arms disclosed in the above identified co-pending applications, which are incorporated herein by reference.

Figure 4:
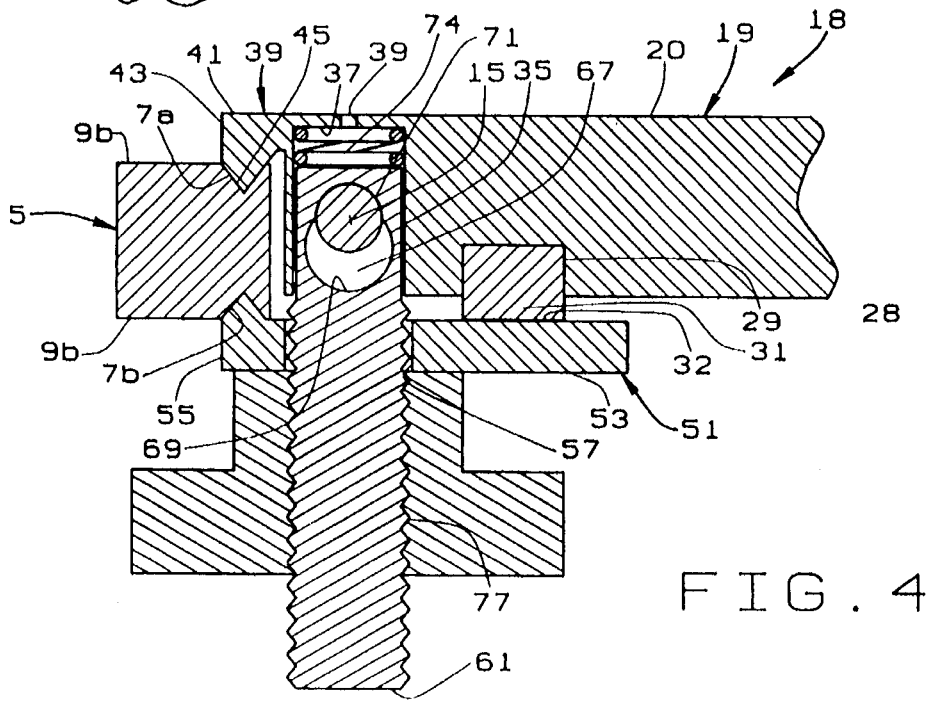
FIG. 4 is a cross-sectional view of the bow sight assembly taken along line 4—4 of FIG. 2.

Sight assembly 1 includes a slide 4 having a slide bar 5 which is secured to the arm 3. Slide bar 5 is generally rectangular in cross-section, as seen in FIG. 4, and has a pair of identical, generally V-shaped grooves 7*a,b* formed on opposite sides 9*a,b* of the slide bar. Preferably, grooves 7*a,b* are positioned near a front surface 11 of slide bar 5 and are aligned with each other, so that the slide has a vertical axis of symmetry. A pair of arms 13 extend forwardly from slide bar 5 which rotatably receive a threaded rod 15. Rod 15 extends through journal openings in arms 13 and are vertically secured to slide 4 by a upper and lower knobs 17. Knobs 17 are rotatably fixed to ends of rod 15 to vertically secure rod 15 in slide 4, such that the rod may be rotated in the journal openings 16.

A two piece pin mount 18 includes a first mounting block 19 and a second mounting block 51. Mounting block 19 is secured to the slide for vertical movement relative to the slide. Block 19 includes a body 20 having an opening 21 near the front thereof through which a pin assembly 23 is slidably received. Pin assembly 23 is substantially the same as set forth in the above noted applications. A slot 25 extends from the top surface of block 19 to opening 21 and a set screw 27 passes though a screw hole in the block to fix the pin assembly in the block relative to the block. Body 20 is sized and shaped such that in assembly 1, the inner surface 28 of body 20 is spaced from surface 9*b* of slide bar 5. A generally vertical groove 29 is thus formed in block body 19 rearwardly of opening 21 to receive a generally rectangular bar 31. Bar 31 has a length approximately equal to the height of block 19 so that the tops and bottoms of bar 31 and block 19 are therefore generally flush with each other. Bar 31 has a depth greater than that of groove 29, as shown in FIG. 4, and bar 31 extends outwardly from inner surface 28 of block 19, defining a step therewith, having an inner surface 32 that is generally flush with the surface 9*b* of slide bar 5. A vertical throughbore 33 is formed at the back of block body 20 through which threaded rod 15 extends. Throughbore 33 has a diameter slightly greater than the diameter of rod 15, so that the block may be easily slid along the length of rod 15. A second bore 35 is formed in the inner surface of block body 20 and communicates with bore 33. Bore 35 is generally perpendicular to bore 33. Bore 35 is a blind bore, having a back wall 37. A small bore 39 may be formed in wall 37.

Block 19 includes a leg 39 integrally formed with body 20 and extending rearwardly of body 20. Leg 39 has an outer wall 41 which is flush with the outer wall of block body 20 and a planar back surface 43. The inner surface 45 of leg 43 is beveled, or generally triangular, to conform to the shape of slide grooves 7*a,b*. The leg's triangular surface 45 is received in slide groove 7*a*, as shown in FIGS. 2 and 4. As will be explained below, block 19 forms one part of a clamp which holds the pin assembly 23 in place relative to the slide 4. Hole 33 is horizontally spaced from the inner surface of leg 39 a distance sufficient to provide that the leg 39 will be at least loosely received in groove 7*a* when rod 15 is passed through hole 33.

A second block 51 is positioned along side 9*b* of slide bar 5. Block 51 has a body 53 and a rear leg 55. Leg 55 is generally identical to leg 39 and is received in slide bar groove 7*b*. Block body 53 has an opening 57 equal in diameter to, and axially aligned with, bore 35 of first block body 20. When sight 1 is assembled, the inner surface of block 51 contacts the inner surface 32 of bar 31. Second block 51 forms a second part of the clamp.

A cylindrical bar 61 is received in bore 35 of block 19 and passes across slide bar 5 and through opening 57 in body 53. Bar 61 has a generally smooth back portion 63 which is received in bore 35 and an external threaded front portion 65. An opening 67 is foraged in back portion 63 and extends generally perpendicularly to the axis of bar 61. Threaded bar 15 passes through opening 63 to substantially position bar 63 with respect to block 19 and to maintain the bar in the block bore 35. Opening 63 is formed from two communicating circles. The first circle 69 is substantially equal in diameter to the throughbore 33 of body 20. Circle 69 has smooth walls. The second circle 71 is slightly smaller in diameter than circle 69, having a diameter approximately equal to the diameter of threaded rod 15. Circle 71 is internally threaded, as at 73, so that threads 73 can mate with the threads of rod 15. Circles 71 and 69 are formed so that when bar 61 is inserted in bore 35, circle 61 is closer to bore wall 37. A spring 74 is positioned in bore 35 between wall 37 and bar 61. Spring 74 serves to bias the bar so that threaded bar 15 is normally engaged by the threads of circle 71.

A knob 75 has an internally threaded bore 77 and is threaded onto the threaded end 65 of bar 61. When knob 75 is tightened down against block 51, it pushes block 51 towards block 19, to secure the pin assembly 23 in place relative to slide 4. When the knob is tightened down, it pushes leg 55 of block 51 into slide groove 7*b*. It also pushes block 51 against bar 31 of block 19, causing block 19 to pivot around bit 15, urging leg 39 into groove 7*a*. Thus, the two part mounting block crates a clamping action which bears down on, or externally clamps against, slide bar 5 when the knob 75 is tightened. The interaction of the two part mount and the slide bar, insure that the pin assembly 23 will virtually always be perpendicular to slide 4 when the knob is tightened. The archer can thus change the pin position, without having to adjust the orientation of the pin assembly.

As set forth in the above noted co-pending applications, when the rod 15 is engaged by the threaded circle 71, the mount 18 can be moved vertically by rotating the rod 15. As can be appreciated, rod 15 is rotated by turning knob 17. Alternately, by slightly loosening the mount, the bar 61 can be pushed inwardly, to depress spring 74 and to bring circle 69 into alignment with bore 33, so that it is co-axial with rod 15. In this position, the mount 18 can slide relative to the rod. Thus, mount 18 provides for both gross and fine adjustment of the mount position.

As variations within the scope of the appended claims may be apparent to those skilled in the art, the foregoing description is set forth only for illustrative purposes and is not meant to be limiting. For example, the block 19 can be molded, machined, or otherwise formed so that the bar 31 is integrally formed with the block, making the block a one-piece element of assembly 1. Body 20 of block 19 could also be wider, so that the inner surface of body 20 is flush with surface 9*b* of slide bar 5. This would eliminate the need for bar 29. The grooves 7*a,b* and the inner surfaces of legs 39 and 55 could have different shapes. They could, for example, be semicircular, rectangular, or multi-faceted. These examples are merely illustrative.

We claim:

1. An archery bow sight including a slide; a two-part mount secured to said slide for axial movement relative to said slide; and a sight secured to said sight mount;

said slide including a slide bar having a top and a bottom, a top arm extending forwardly from said slide bar top, a bottom arm extending forwardly from said slide bar bottom; a threaded rod extending between said top and bottom arms, said threaded rod being rotatably journaled in said top and bottom arms; said slide bar having opposing side surfaces, said side surfaces defining elongate grooves therein extending between said slide bar top and bottom; said slide bar defining a path of travel;

said two-part mount including a first part and a second part, said sight being secured to one of said first and second parts:

said first part including a body having an inner surface and a leg extending rearwardly from said first part body; a generally vertical throughbore extending through said first part body, said threaded rod extending through said throughbore; and a bore formed in said inner surface and communicating with said throughbore; said leg having an inner surface shaped complimentary to said slide bar grooves to be received in a first of said slide bar grooves;

said second part including a body having an inner surface, a leg extending rearwardly from said second part body, and an opening extending through said second part body, said opening being axially aligned with said bore of said first part; said second part inner surface contacting at least a portion of said inner surface of said first part; said leg having an inner surface shaped complimentary to said slide bar grooves to be received in a second of said slide bar grooves;

a threaded bar having a first end received in said first part bore and a second end extending through said second part opening; said first end having an opening generally aligned with said first part throughbore through which said slide bar threaded rod extends;

a knob received on said second end of threaded bar; said knob being operable to urge said first and second part legs into said slide bar grooves such that said two-part mount clamps against said slide bar to secure said sight in a desired position on said path of travel.

2. The archery bow sight of claim 1 wherein said slide bar grooves are identical, said grooves being generally V-shaped.

3. The archery bow sight of claim 2 wherein the inner surfaces of said legs of said first and second parts are generally triangular in shape, said inner surfaces being shaped complimentary to said grooves.

4. The archery bow sight of claim 1 wherein said threaded bar bore is generally oblong, said bore having a first circular surface and a second circular surface, said first and second circular surfaces being in communication with each other.

5. The archery bow sight of claim 4 wherein said second circular surface is at least partially threaded, said first circular surface being generally smooth, said threaded bar being spring biased so that said second circular surface normally engages said threaded rod of said slide, said mount being movable along said path of travel by rotating said threaded rod.

6. The archery bow sight of claim 5 wherein said threaded bar is movable perpendicularly relative to said threaded rod to disengage said threaded surface of said second circle from said threaded rod, to generally coaxially align said threaded rod with said first circular surface, said mount being slidable movable along said path of travel when said second circle threaded surface is disengaged from said threaded rod.

7. The archery bow sight of claim 1 wherein said mount first part has a back surface spaced from a front surface of said slide bar.

8. The archery bow sight of claim 1 wherein a majority of said first part inner surface is spaced from said inner surface of said second part, one of said first and second parts including a step which extends between said inner surfaces of said first and second parts.

9. The archery bow sight of claim 8 wherein said step is integrally formed with said one of said first and second parts.

10. The archery bow sight of claim 8 wherein said one of said first and second parts defines a groove in said inner surface, said groove receiving a generally rectangular bar, said generally rectangular bar extending inwardly of said inner surface and defining said step.

11. The archery bow sight of claim 8 wherein said step is positioned rearwardly of said first body bore and said second body openings.

* * * * *